United States Patent [19]

Kent

[11] 4,210,483

[45] Jul. 1, 1980

[54] APPARATUS FOR MAKING AN INDUCTIVE DELAY LINE COMPONENT

[75] Inventor: Bryan P. Kent, San Diego, Calif.

[73] Assignee: Variani Associates, Inc., Palo Alto, Calif.

[21] Appl. No.: 28,232

[22] Filed: Apr. 9, 1979

[51] Int. Cl.[2] ..... B31F 1/00

[52] U.S. Cl. ..... 156/443; 29/605; 29/606; 242/7.09

[58] Field of Search ..... 29/602 R, 605, 606; 336/185, 180, 212, 205; 242/7.06, 7.09, 7.11, 7.07; 156/446, 425, 443

[56] References Cited

U.S. PATENT DOCUMENTS

| | | | |
|---|---|---|---|
| 3,051,930 | 8/1962 | Austen | 336/205 X |
| 3,101,180 | 8/1963 | Sadorf | 242/7.09 |
| 3,332,633 | 7/1967 | Carson | 242/7.09 |
| 3,451,633 | 6/1969 | Markham et al. | 242/7.09 |
| 3,981,333 | 9/1976 | Breu | 29/605 X |

*Primary Examiner*—David A. Simmons

*Attorney, Agent, or Firm*—Stanley Z. Cole; Peter J. Sgarbossa

[57] ABSTRACT

Apparatus for making the inductive component of a delay line containing multiple wire wound bobbins in a linear assembly. The component comprises a pair of multiple post bobbin units secured together with the bobbins interfitting in a row, each bobbin being wire wound. The apparatus simultaneously winds all bobbins on each unit with a uniform number of turns of wire, then secures the two units together while maintaining tension on the wire to prevent slippage. Bobbin units are fed into holders which are indexed successively to a winding station, an adhesive application station and a joining station, the completed components being wound on a storage spool while still in a string on the wires. The winding heads are driven to move in an elliptical path around the bobbin posts to provide clearance between the posts and to maintain constant wire tension in the windings.

18 Claims, 11 Drawing Figures

APPARATUS FOR MAKING AN INDUCTIVE DELAY LINE COMPONENT

BACKGROUND OF THE INVENTION

A delay line provides a series of timed pulses from a single input pulse and is used in the clock circuit of a computer memory, as one example. The typical delay line comprises a series of inductors and capacitors, the circuit being well known. In the very small sizes of delay lines in use the wire wound inductance elements are difficult to make and assemble accurately. One type of inductive element comprises spaced windings along a rod and another type has windings on individual bobbins. The bobbins are preferred since the mutual inductance is more easily controlled and fewer turns of the winding are required, resulting in lower DC resistance and thus lower attenuation.

The accepted technique for making the bobbin type assembly is to wind each bobbin individually, usually by hand, then assemble a number of bobbins in a row and mount them in a suitable supporting and conncecting structure. It is a tedious task and uniformity of winding and consistency in the number of turns are difficult to maintain. Some idea of the difficulty can be realized by the fact that a typical bobbin is on the order of 2.5×2.5·1.5 mm in size. Mounting such small bobbins in an even row and maintaining the alignment during electrical connection and final packaging of the component is also a problem. Since any misalignment of the bobbins and windings can cause changes in electrical performance, precise alignment is desirable for consistency.

SUMMARY OF THE INVENTION

The apparatus described herein will produce inductive delay line components with precisely aligned bobbins and consistent coil windings, in a fraction of the time required to wind and assemble individual bobbins. The bobbins used are in the form of multiple posts of ferrite material fixed to or formed integrally with a connecting plate, the posts being spaced in a row along the plate. Two such bobbin elements are used to make a delay line, the two being secured together with the posts of one fitting between the posts of the other and the connecting plates forming outside walls.

The bobbin elements are fed in pairs into adjacent holders and multiple needle heads wind coils on all the posts simultaneously. The heads move in substantially elliptical paths to rotate around and pass between the posts, while having a sufficient range of motion to clear the posts and maintain constant tension on the wires. After winding is complete, the holders are indexed and adhesive is applied to posts of one bobbin element. The holders are then indexed again and the two bobbin elements are pressed together and adhered into an integral component. The components are wound on a storage spool, still strung on the wires, and are separated as required for incorporation in a complete delay line.

Simultaneous winding of the bobbins greatly reduces the winding time, while the uniformity of the windings and the precise alignment of the coils in the finished article insure consistency in electrical characteristics. Manufacturing cost and time are greatly reduced since manual winding and assembly are eliminated.

The primary object of this invention, therefore, is to provide new and improved apparatus for making an inductive delay line component.

Another object of this invention is to provide apparatus which will simultaneously wind all coils on a pair of multiple bobbin elements.

Another object of this invention is to provide apparatus which consistently wind coils with a uniform number of turns at a constant tension on the wires.

A further object of this invention is to provide apparatus which joins the pair of bobbin elements into a finished component with the bobbins interfitting.

Other objects and advantages will be apparent in the following detailed description, taken in conjunction with the accompanying drawings, in which.

DESCRIPTION OF THE PREFERRED EMBODIMENT

Figure 1:
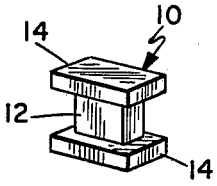
Fig. 1 PRIOR ART
FIG. 1 illustrates a bobbin of the type which is manually wound.
Figure 2:
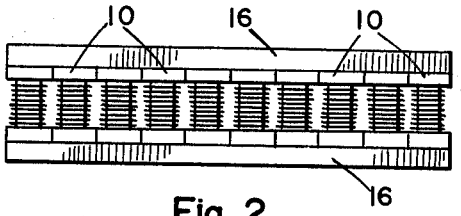
Fig. 2 PRIOR ART
FIG. 2 is a side elevation view of a delay line assembled from individual bobbins, according to the prior art.

The hand wound type of delay line utilizes individual bobbins 10, as illustrated in FIG. 1. This bobbin has a generally rectangular body 12 with end flanges 14, the coil being wound around the body and held in place between the flanges. A row of these wound bobbins 10 is assembled and held between connecting plates 16, as in FIG. 2, or sometimes the row of bobbins is wrapped with adhesive tape. It will be obvious that the hand winding may vary in quality and even in the number of turns on the coils, and that the bobbins may not be precisely aligned in the assembly.

Figure 3:
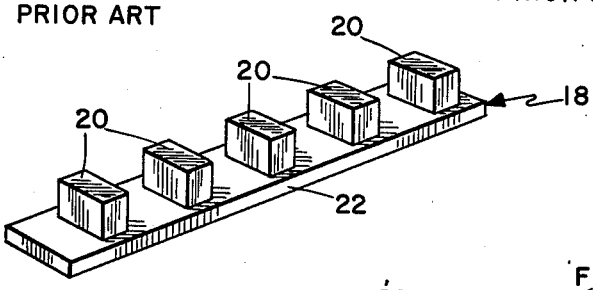
FIG. 3 is a perspective view of a multiple bobbin element used in the apparatus.

The apparatus described herein uses bobbin elements 18, as illustrated in FIG. 3, in which a plurality of posts 20 are spaced along an elongated connecting plate 22. The bobbin element is preferably an integral structure molded from ferrite material, resin bonded powdered iron, or similar inductive material. While the size may vary, it should be noted that a typical bobbin element is on the order of 16 mm in length and 2.5 mm wide, which will indicate the intricacy of the winding operation. Two bobbin elements are used to make the component and are jointed with the posts interfitting and the connecting plates forming outside walls. The spacing between posts is thus sufficient to allow the interfitting.

Figure 4:
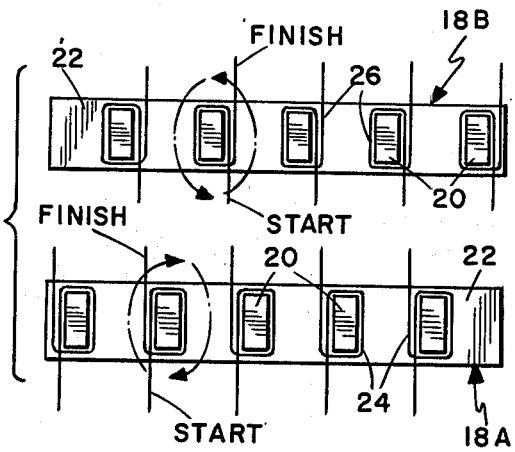
FIG. 4 illustrates the simultaneous winding technique.

The two bobbin elements are wound simultaneously in the manner illustrated in FIG. 4. Bobbin element 18A is wound in a clockwise direction and bobbin element 18B is wound in a counter-clockwise direction. The windings are also oriented so that the finish ends of the windings 24 on element 18A confront the starting ends of the windings 26 on element 18B. In the apparatus to be described the bobbin elements are held in this orientation during winding and are brought together so that the finish ends of one element are adjacent the start ends of the other element. The wire ends are thus automatically positioned for simple series connection of the interfitting coils, with alternate coils wound in opposite directions for optimum magnetic properties.

Figure 5:
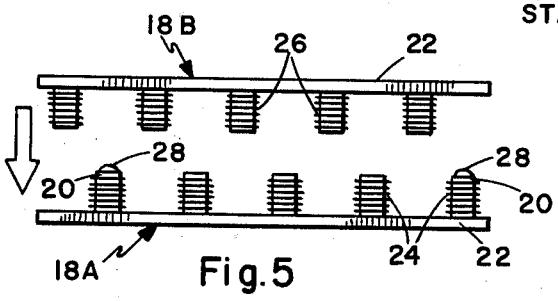
FIG. 5 is a side elevation view of two wound bobbin elements in position for joining.

Prior to joining the bobbin elements, drops of adhesive 28 are applied to the end posts of one element, as in FIG. 5. When the elements are joined the adhesive bonds to the connecting plate of the other element, making the inductive component 30 shown in FIG. 6. It has been found that this adhesive bonding is sufficient, since the completed delay line assembly is usually potted in a block of protective material and there is no strain on the structure.

Figure 6:
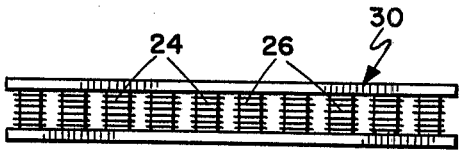
FIG. 6 is a side elevation view of a completed inductive delay line component.

For simplicity the wire ends are omitted from FIGS. 5 and 6. In the actual manufacture the components remain on the continuous wires in a string and are not cut free until required.

The apparatus illustrated in FIGS. 7–11 is constructed on a frame 32, having a base plate 34 and an upright wall 36. The bobbin handling mechanisms is carried on a vertical mounting plate 38 fixed to one end of base plate 34, while the winding mechanism is on a vertically movable horizontal platform 40.

Fixed on wall 36 are brackets 42 which hold a pair of vertical guide posts 44. Platform 40 has an upright back plate 46 with trunnions 48 and 50 which are slidable along the guide posts 44. Vertical movement of the platform 40, which is very limited, is controlled by a feed screw 52 rotatably mounted in a bearing 53 in the top bracket 42 and threaded through trunnion 48. The feed screw 52 is driven by a drive belt 54 from a stepping motor 56 mounted on wall 36, as in FIG. 7.

On the front face of mounting plate 38 are two bobbin element holders in the form of cylindrical indexing drums 58 and 60, rotatably mounted side by side on shafts 62 and 64, respectively. The drums are driven by a motor 66 through an indexing mechanism 68, mounted on base plate 34. Any suitable indexing means, such as a Geneva mechanism, stepping drive, or the like may be used.

Each indexing drum has circumferentially spaced bobbin receiving slots 70 extending axially from front to rear, each slot being connected to the interior of the drum through a pair of holes 72. As illustrated, each drum has four slots 70 at 90 degree spacing, but more or less slots may be used. Drum 58 is rotated clockwise and drum 60 is rotated counter-clockwise, as indicated by the directional arrows in FIG. 7. Coil winding occurs at a winding station 71 vertically above the rotational axis of each drum.

Bobbin elements are fed to a loading station 73 on each drum by a feed mechanism 74, which may be any suitable type of sorting and feeding means for taking articles from a supply and feeding them one at a time to a particular loading station. Such mechanisms are well known and various types are adaptable to the apparatus.

Each drum has a fixed front cover 76 supported on a common bracket 78 extending from mounting plate 38. Inside each drum is a vacuum chamber 80 extending from adjacent the loading to a joining station 81 at the horizontal position between the drums. Any suitable vacuum source, not shown, is connected to the chambers 80 to apply vacuum through holes 72 and retain the bobbin elements 18 in slots 70.

In each drum at the joining station 81 is a horizontally movable pressure bar 82 having a pair of pins 84 which fit through holes 72. An actuating arm 86, pivotally mounted on bracket 78, has one end connected to the pressure bar 82 in drum 58, the other end of the actuating arm being connected to the push rod 88 of an actuator 90 secured to the bracket. A connecting link 92 extends from actuating arm 86 to the pressure bar 82 in drum 60, so that when push rod 88 moves to the left in FIG. 7, both pressure bars 82 move inwardly and pins 84 project toward each other through holes 72, as in FIG. 10.

The winding mechanism includes a pair of winding heads 94 and 96, each having a row of vertical hollow needles 97 fixed in spaced relation to correspond to the spacing of posts 20. The heads 94 and 96 are at the forward ends of a pair of winding arms 98 and 100, respectively, which are suspended below platform 40. Head 94 is positioned above the winding station 71 of drum 58 and head 96 is above the winding station of drum 60. Winding arm 98 is oscillated horizontally by an eccentric 102 on the lower end of a shaft 104 extending downwardly through the platform 40, and engaging the arm adjacent the head. Winding arm 100 is similarly driven by an eccentric 106 on the lower end of a shaft 108 extending through the platform.

It can be seen in FIG. 4, that for the needles to pass between the posts 20 yet still swing far enough to either side to wind the wire around the posts, the needles must follows a generally elliptical path, indicated by the directional arrows, with the major axis perpendicular to the bobbin element. This also provides a substantially constant tension of the wire around the rectangular posts. To obtain this motion the rear ends of winding arms 88 and 100 are supported on guide rollers 110 rotatably mounted below platform 40. The winding arms are held against the guide rollers by a spring 112 stretched between the arms and are thus free to move longitudinally. This type of mechanism is well known and is similar to that used in an ellipsograph. The major and minor axes of the ellipse are dependent on the throw of the eccentric, the distance from the eccentric axis to the support at the end of the arm, and the distance from the eccentric axis to the stylus, or needles.

Mounted on back plate 46 is a drive motor 114 coupled through a clutch 116 to a drive shaft 118, which rotates shaft 108 by means of a drive belt 120. Shaft 104 is driven from shaft 108 by a drive belt 122 and reversing gears 124 and 126, so that the eccentrics are rotated in opposite directions. The clutch 116 allows motor 114 to operate at a constant speed, so that there is no lag or over-run in the winding operation.

Supply spools or other sources of wire, not shown, can be stored on a shelf 128 fixed on top of guide posts 44, or at any other convenient location clear of the mechanism. On the shelf 128 is a friction pad 130, of felt or the like, through which all the wires are threaded to maintain a light tension on the wires and avoid tangling. Individual wires 132 are taken from the supply, through guides 134 on platform 40 and are threaded through the needles 97.

Below the joining station 81 is an extractor 136, comprising a pair of confronting belts 138 supported on pulleys 140 from the mounting plate 38. One of the pulleys is driven by a drive belt 142 from shaft 62, at the correct speed to pull the string of completed components down and maintain a light tension on the wires. Below the extractor is a storage spool 144 on which the string of components is wound as it is formed. The storage spool may be driven if desired to take up the component string.

At each winding station 71 the bobbin element is held in longitudinal alignment with the winding head against a stop 146 fixed in each slot 70. The bobbin element is pressed against the stop by a retaining roller 148 mounted on an arm 150, which extends from a bracket 152 on the top of mounting plate 38. The forward end of stop 146 has an inclined undercut 151 which jams the bobbin element firmly down into the slot. Arms 150 are biased by any suitable means, such as springs or torsion mountings, to bear against the bobbin elements.

Offset from the winding station of drum 58, in the direction of rotation, is an adhesive head 154 having a pair of applicators 156 spaced to match the end posts 20 of the bobbin element 18. An actuator 158 moves the applicators 156 into contact with the bobbin element to apply the two drops of adhesive 28, as in FIG. 4. The applicators may be pressurized or operated by motion of the actuator to eject the adhesive, various types being well known.

Figure 7:
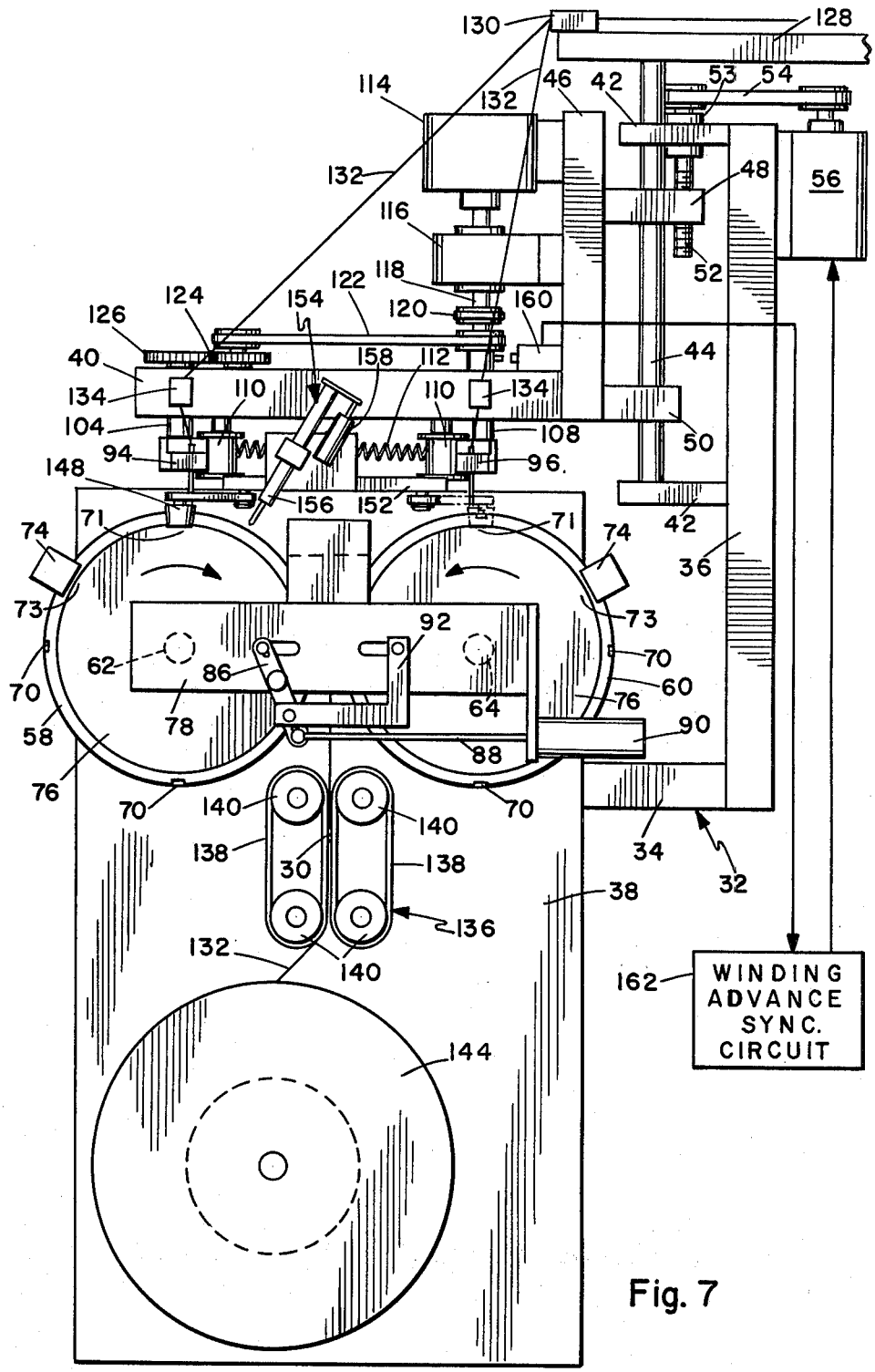
FIG. 7 is a front elevation view of the winding apparatus.
Figures 8, 11:
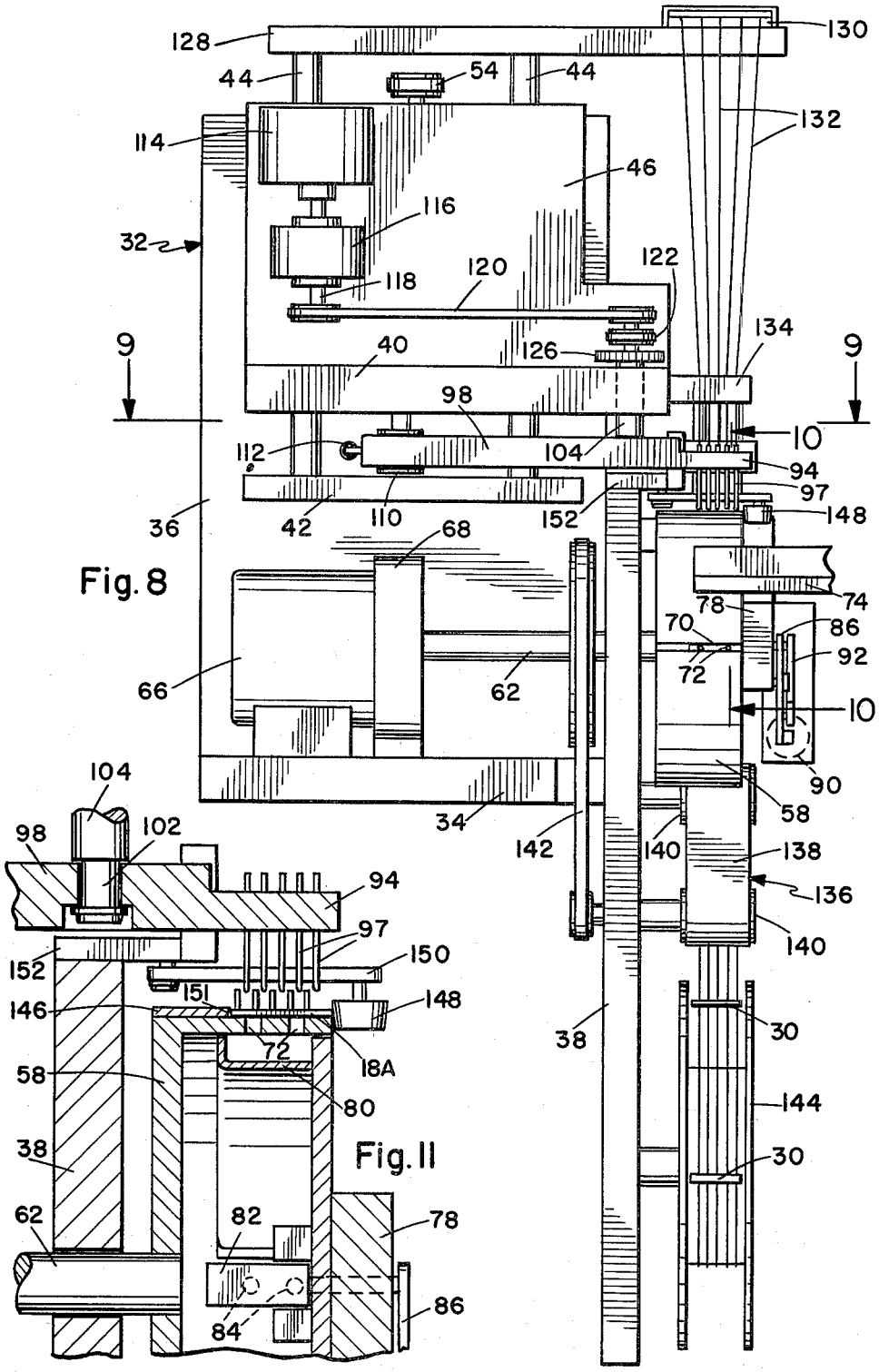
FIG. 8 is a side elevation view of the apparatus.
FIG. 11 is a sectional view taken on line 11—11 of FIG. 10.
Figure 9:
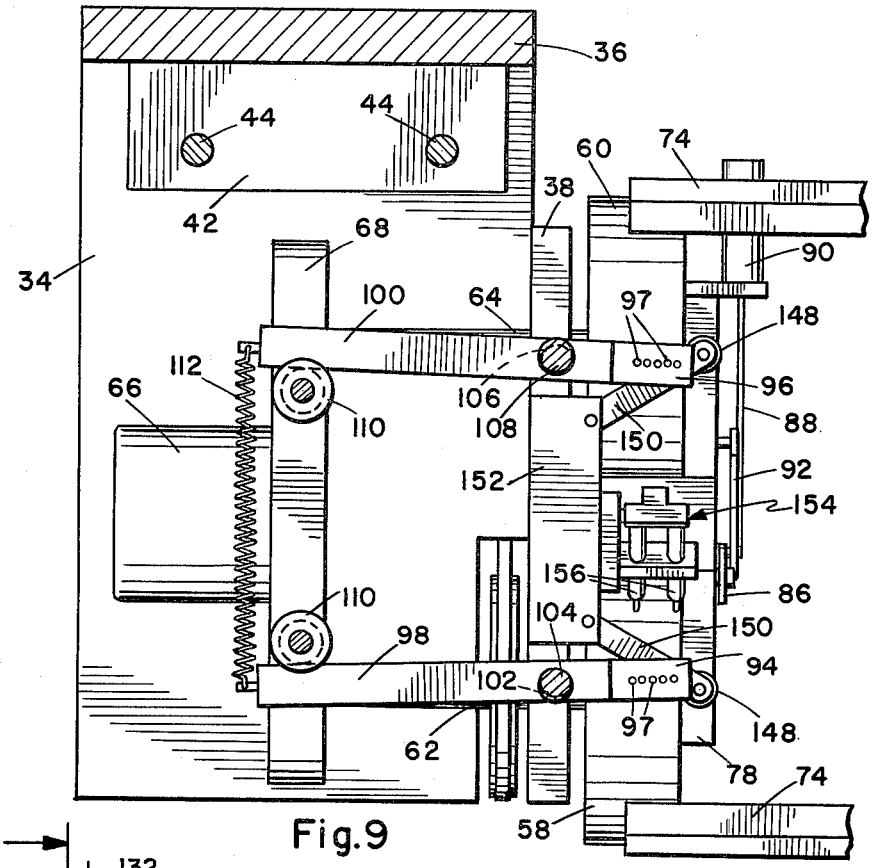
FIG. 9 is a sectional view taken on line 9—9 of FIG. 8.
Figure 10:
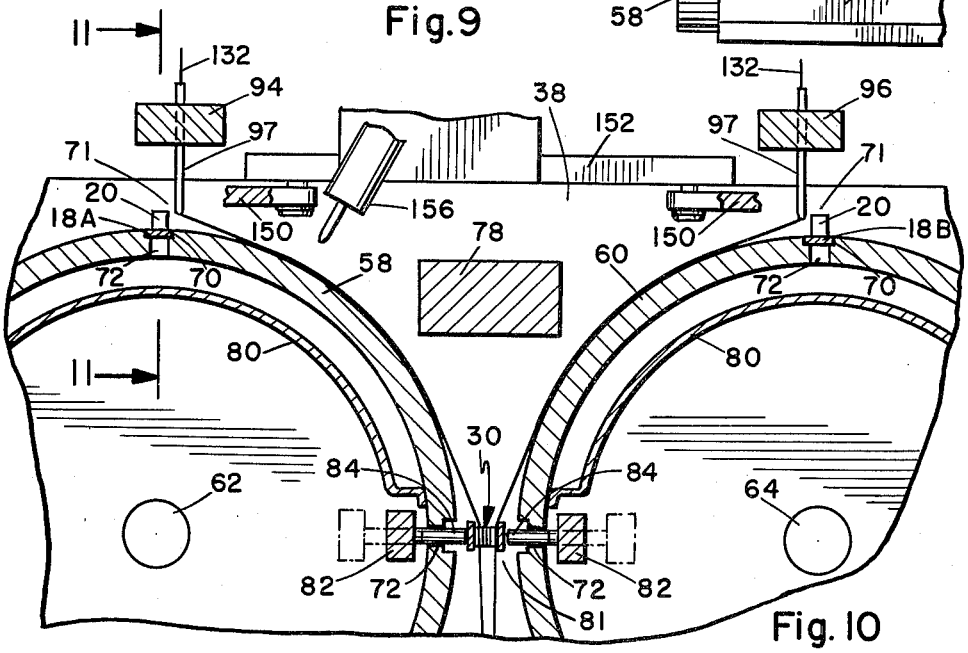
FIG. 10 is an enlarged sectional view taken on line 10—10 of FIG. 8.

In operation, bobbin elements 18 are loaded into both drums 58 and 60 at loading stations 73. The drums are then indexed to bring the bobbin elements to the winding stations 71, at which time clutch 116 is engaged so that motor 114 drives the eccentrics 102 and 106 and operates the winding heads. At the same time, stepping motor 56 is actuated to move the platform 40 vertically and distribute the windings over the height of the posts 20. Synchronizing means may be used to advance the winding heads one step vertically for each turn of wire, the motion being very small. This can be accomplished by means of a pulse counter 160 positioned to sense the rotation of shaft 108 and trigger the stepping motor 56 through a simple synchronizing circuit 162, as indicated in FIG. 7. Each pulse or rotation of the shaft triggers the stepping motor to move the platform, and thus the needles 97, by an increment substantially equal to the diameter of the wire. If two layers of windings are required, the stepping motor can be driven in one direction for a specific number of turns and then reversed for the next set of turns. If only one layer of wire is to be wound, the stepping motor can return the winding heads to the starting position while the winding heads are stationary.

After winding is complete, the drums are indexed to bring the bobbin element on drum 58 into line with the adhesive head 154, where the adhesive is applied. The drums are then indexed to bring the wound pair of bobbin elements to the joining station 81. In this position actuator 90 is triggered to bring the pressure bars 82 together, so that pins 84 push the bobbin elements from their slots and press them together, as in the full line position in FIG. 10. As the drums are indexed further, the completed inductive component 30 is pulled down between belts 138 and held momentarily during a successive winding cycle, allowing the adhesive to bond more securely. All operations are, of course, taking place continuously at the various stations. The inductive components are then taken up on the storage spool 144 in a continuous string on the wires 132. By keeping the components in a string in this manner, tension can be maintained on the wires throughout their path, which prevents tangling and results in neater windings.

The various functions can be controlled by simple timing mechanisms or by a programmed microprocessor, the techniques being well known.

Having described my invention, I now claim:

1. Apparatus for making an inductive delay line component composed of a pair of bobbin elements of inductive material, each having an elongated connecting plate with a longitudinal row of spaced posts extending perpendicularly from one side thereof, the apparatus comprising:

a frame;

a pair of holders mounted on said frame, each having means for holding a bobbin element therein;

indexing means for moving said holders to position the bobbin elements therein at a pair of winding stations;

winding means at each winding station for winding wire around all the posts on the bobbin elements simultaneously;

said indexing means being operable to move said holders to a joining station with the bobbin elements in close confronting relation;

joining means on said holders for pressing the bobbin elements together with the posts interfitting, and bonding the elements to form the inductive delay line component;

and extraction means for removing the component from said holders.

2. Apparatus according to claim 1, and including means between the winding stations and joining station for applying adhesive to a portion of at least one of the bobbin elements.

3. Apparatus according to claim 1, wherein said winding means includes a winding head at each winding station having a plurality of hollow wire conducting needles corresponding to and spaced to pass between the posts of the bobbin element;

and actuating means coupled to said winding head to rotate the needles around the posts.

4. Apparatus according to claim 3, wherein said actuating means has a drive mechanism for moving the winding head in a substantially elliptical path, with the major axis thereof perpendicular to the bobbin element.

5. Apparatus according to claim 1, wherein said holders are cylindrical drums rotatable mounted on parallel axes in side by side relation, said indexing means rotating the drums in opposite directions;

each of said drums having circumferentially spaced, axially extending slots, each for holding a bobbin element therein.

6. Apparatus according to claim 5, wherein said winding means includes a pair of winding heads, one at each winding station, each head having a plurality of hollow wire conducting needles corresponding to and spaced to pass between the posts of the bobbin element;

and actuating means coupled to said winding heads to rotate the needles around the posts.

7. Apparatus according to claim 6, wherein said actuating means is coupled to rotate the heads in opposite directions.

8. Apparatus according to claim 6, wherein each of said winding heads has an elongated arm extending therefrom, said actuating means including an eccentric rotatable mounted in each arm adjacent the head, the ends of said arms remote from the heads being supported with limited freedom of longitudinal movement.

9. Apparatus according to claim 8, and including drive means coupled to said eccentrics to rotate the eccentrics in opposite directions.

10. Apparatus according to claim 6, and including advance means coupled to said heads to move the heads progressively, substantially radially to the drums, as the needles are rotated around the posts, to distribute the windings along the posts.

11. Apparatus according to claim 6, wherein the winding stations are positioned substantially vertically above the axes of the respective drums, and the joining station is at the horizontal confrontation of the drums;

and including feed stations preceding the winding stations, in the direction of rotation, with feed means for inserting bobbin elements in said slots.

12. Apparatus according to claim 11, wherein said slots have holes opening into the interiors of the drums, each drum having a vacuum chamber therein extending from the feed station to a position adjacent the joining station, for applying vacuum through said holes to retain the bobbin elements in the slots.

13. Apparatus according to claim 12, wherein each drum has joining means therein with pins positioned to project through said holes at the joining station and eject the bobbin element from the slot to interfit with the bobbin element from the opposed slot, and means for actuating said joining means simultaneously;

and means between said winding stations and said joining station for applying adhesive to at least one of the bobbin elements.

14. Apparatus according to claim 11, and including a platform vertically movably mounted on said frame, said winding heads being mounted on said platform, and advancing means for moving the platform and the winding heads vertically in synchronization with the rotation of the heads, to distribute the windings over the posts.

15. Apparatus according to claim 14, wherein said advancing means includes a counter for counting the rotations of the heads, and a stepping motor coupled to move said platform and triggered by said counter to advance the platform at each revolution of the heads.

16. Apparatus according to claim 12, wherein each of said slots has a stop for engaging one end of a bobbin element therein, with the other end of the bobbin element at a peripheral edge of the drum;

and including a retaining roller biased against the peripheral edge adjacent each winding station to seat the bobbin element against the stop.

17. Apparatus according to claim 11, and including guide means for guiding a plurality of wires from a source to said winding heads and feeding the wires through the joining station with the components retained in a string on the wires, the guide means having a friction pad adjacent the source through which the wires pass, for maintaining tension on the wires through the apparatus.

18. Apparatus according to claim 17, wherein said extraction means comprises a pair of confronting belts rotatably mounted below the joining station, said belts being driven to grip and pull the components and connecting wires downwardly from the joining station.

* * * * *